US011333165B2

(12) United States Patent
Iwata et al.

(10) Patent No.: US 11,333,165 B2
(45) Date of Patent: May 17, 2022

(54) PROPELLER FAN

(71) Applicant: DAIKIN INDUSTRIES, LTD., Osaka (JP)

(72) Inventors: Tooru Iwata, Osaka (JP); Hirotaka Tomioka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 198 days.

(21) Appl. No.: 16/471,284

(22) PCT Filed: Dec. 8, 2017

(86) PCT No.: PCT/JP2017/044226

§ 371 (c)(1),
(2) Date: Jun. 19, 2019

(87) PCT Pub. No.: WO2018/123519

PCT Pub. Date: Jul. 5, 2018

(65) Prior Publication Data

US 2019/0316599 A1 Oct. 17, 2019

(30) Foreign Application Priority Data

Dec. 28, 2016 (JP) ..... JP2016-255373
Apr. 14, 2017 (JP) ..... JP2017-080267

(51) Int. Cl.
*F04D 29/38* (2006.01)
*F04D 29/66* (2006.01)

(52) U.S. Cl.
CPC ..... *F04D 29/384* (2013.01); *F04D 29/667* (2013.01)

(58) Field of Classification Search
CPC .... F04D 29/386; F04D 29/325; F04D 29/667; F04D 29/384; F05D 2240/303; F05D 2240/304; F05D 2240/307
See application file for complete search history.

(56) References Cited

FOREIGN PATENT DOCUMENTS

| | | | | | |
|---|---|---|---|---|---|
| CN | 102341603 | A | | 2/2012 | |
| JP | 2001-227498 | A | | 8/2001 | |
| JP | 2001227498 | A | * | 8/2001 | ..... F04D 29/384 |
| JP | 3608038 | B2 | | 1/2005 | |
| JP | 2010-275986 | A | | 12/2010 | |
| JP | 2010275986 | A | * | 12/2010 | |
| JP | 2012-52443 | A | | 3/2012 | |
| JP | 2012052443 | A | * | 3/2012 | |

* cited by examiner

*Primary Examiner* — Sabbir Hasan
(74) *Attorney, Agent, or Firm* — Birch, Stewart, Kolasch & Birch, LLP

(57) ABSTRACT

In a blade of a propeller fan, a position on a chord line where the camber becomes maximum is set as a maximum camber position A, and a ratio of a distance d between a leading edge and the maximum camber position A to a chord length c is set as a maximum camber position ratio. The end portion on the hub side of the blade is set as a blade root, and the end portion on the outer circumferential side of the blade is set as a blade end. In the blade, the maximum camber position ratio monotonically increases in the direction from the reference blade cross section located between the blade root and the blade end toward the blade end and becomes maximum at the blade end. Thus, fan efficiency of the propeller fan is improved.

13 Claims, 13 Drawing Sheets

PROPELLER FAN

TECHNICAL FIELD

The present invention relates to a propeller fan for use in a blower or the like.

BACKGROUND ART

Conventionally, a propeller fan is widely used for a blower or the like. For example, Patent Document 1 discloses a propeller fan having a hub and three blades.

The blade of a general propeller fan is formed to have a curved shape so as to bulge in the direction of the negative pressure surface side. That is, in the blade of the propeller fan, the camber, which is a distance from a chord line to a mean line in a blade cross section, becomes maximum between the leading edge and the trailing edge along the chord line of the blade. As can be seen from FIG. 6 of Patent Document 1, in each blade of the propeller fan, a position at which the camber becomes maximum in the blade cross section is set to be located gradually closer to the leading edge in the direction from the blade root toward the blade end.

CITATION LIST

Patent Documents

Patent Document 1: Japanese Unexamined Patent Publication No. 2012-052443

SUMMARY OF THE INVENTION

Technical Problem

In a blade of a propeller fan, air flows back from the positive pressure surface side to the negative pressure surface side via the blade end of the blade, so that a blade end vortex is generated. This blade end vortex is generated in the vicinity of a position where a differential pressure between the positive pressure surface side and the negative pressure surface side of the blade becomes maximum. Therefore, in the blade of the propeller fan, the blade end vortex is generated in the vicinity of a position of the blade end where the camber becomes maximum.

The blade end vortex generated in the blade of the propeller fan develops larger in the direction to the trailing edge of the blade. Therefore, as the position of the blade end where the camber becomes maximum becomes farther away from the trailing edge of the blade, the blade end vortex develops longer. As described above, in each blade of the propeller fan of Patent Document 1, the position where the camber becomes maximum in the blade cross section becomes relatively farther from the trailing edge in the direction from the blade root toward the blade end. Therefore, in the propeller fan of Patent Document 1, the blade end vortex becomes longer and energy consumed for generation of the blade end vortex is increased. As a result, fan efficiency may not be sufficiently improved.

In view of the foregoing, it is therefore an object of the present invention to improve fan efficiency of a propeller fan.

Solution to the Problem

A first aspect of the present disclosure is directed to a propeller fan comprising a cylindrical hub (15) and a plurality of blades (20) extending outwardly from a side surface of the hub (15). Each of the blades (20) is configured such that a distance from a blade chord (31) to a mean line (32) in a blade cross section is set as a camber, that in the blade cross section, a position on the chord line (31) where the camber becomes maximum is set as a maximum camber position (A), that a ratio of a distance (d) between a leading edge (23) and the maximum camber position (A) in the blade cross section to a chord length (c) is set as a maximum camber position ratio (d/c), that an end portion at the hub (15) side of the blade (20) is set as a blade root (21), that an end portion of an outer circumferential side of the blade (20) is set as a blade end (22), and that the maximum camber position ratio (d/c) at the blade end (22) is larger than the maximum camber position ratio (d/c) at the blade root (21).

A blade end vortex (90) is generated in the vicinity of a position where the camber becomes maximum at the blade end (22) of the blade (20) of the propeller fan (10). As the generation position of this blade end vortex (90) approaches to the leading edge (23) of the blade (20), the blade end vortex (90) becomes longer, and energy consumed for the generation of the blade end vortex (90) increases.

In contrast, in each blade (20) of the propeller fan (10) of the first aspect described above, the maximum camber position ratio (d/c) at the blade end (22) is larger than the maximum camber position ratio (d/c) at the blade root (21). That is, in each blade (20), the maximum camber position (A) at which the camber becomes maximum in the blade cross section becomes closer to the trailing edge (24) at the blade end (22) of the blade (20) than in the case of conventional propeller fans. Therefore, the development of the blade end vortex (90) is suppressed and the blade end vortex (90) is shortened so that energy consumed for generation of the blade end vortex (90) is reduced and fan efficiency is improved.

In a second aspect, of the first aspect, according to the present disclosure, each of the blades (20) is configured such that the maximum camber position ratio (d/c) monotonically increases in the direction from a first reference blade cross section (33) located between the blade root (21) and the blade end (22) toward the blade end (22) and becomes maximum at the blade end (22).

According to the second aspect, in each blade (20) of the propeller fan (10), the maximum camber position (A) at which the camber becomes maximum in the blade cross section becomes relatively closer to the trailing edge (24) of the blade (20) from the first reference blade cross section (33) to the blade end (22). The first reference blade cross section (33) is a blade cross section which is separated from the blade root (21) by a predetermined distance.

The phrase "monotonically increase" described in this specification is "weakly increase". Accordingly, in each blade (20), the maximum camber position ratio (d/c) from the first reference blade cross section (33) toward the blade end (22) may continuously increase, or may be constant in some sections from the first reference blade section (33) to the blade end (22).

According to the second aspect, in each blade (20) of the propeller fan (10), the maximum camber position (A) at which the camber becomes maximum in the blade cross section becomes relatively closer to the trailing edge (24) of the blade (20) from the first reference blade cross section (33) to the blade end (22). As a result, in each blade (20) of the propeller fan (10), the generation position of the blade end vortex (90) comes closer to the trailing edge (24) of the blade (20). Therefore, the development of the blade end vortex (90) is suppressed and the blade end vortex (90) is shortened so that energy consumed for generation of the blade end vortex (90) is reduced and fan efficiency is improved.

According to a third aspect of the present disclosure, each of the blades (20) of the second aspect is such that the maximum camber position ratio (d/c) becomes minimum in the above first reference blade cross section (33).

In the blade (20) of the propeller fan (10) of the third aspect, the maximum camber position ratio (d/c) becomes minimum in the first reference blade cross section (33). Therefore, in the region from the blade root (21) to the first reference blade cross section (33) in the blade (20), the maximum camber position ratio (d/c) is equal to or greater than the minimum value.

According to a fourth aspect of the present disclosure, each blade (20) of the third aspect is configured such that the distance from the blade root (21) to the first reference blade cross section (33) is shorter than the distance from the blade end (22) to the first reference blade cross section (33).

In the fourth aspect, in each blade (20) of the propeller fan (10), the first reference blade cross section (33) is positioned closer to the blade root (21) than the center of the blade (20) in the radial direction of the propeller fan (10). In this first reference blade cross section (33), the maximum camber position ratio (d/c) becomes minimum.

According to a fifth to of the present disclosure, each blade (20) of one of the second to fourth aspects is configured such that the maximum camber position ratio (d/c) in the blade cross section described above is equal to or greater than 0.5 to equal to or smaller than 0.8.

In the fifth aspect, in each blade (20) of the propeller fan (10), the maximum camber position ratio (d/c) in the blade cross section is set to a value of equal to or greater than 0.5 to equal to or less than 0.8.

According to a sixth aspect of the present disclosure, each blade (20) of the first aspect is configured such that the maximum camber position ration (d/c) described above becomes maximum in the first reference blade cross section (33) located between the above blade root (21) and the above blade end (22).

In each blade (20) of the propeller fan (10) of the sixth aspect, the maximum camber position ratio (d/c) becomes maximum in the intermediate blade cross section (33*a*) located closer to the blade root (21) than to the blade end (22).

According to a seventh aspect of the present disclosure, each of the blades (20) of the sixth aspect is configured such that the maximum camber position ratio (d/c) becomes minimum at the blade root (21), and monotonously increases from the blade root (21) described above toward the intermediate blade cross section (33*a*).

In each blade (20) of the propeller fan (10) of the seventh aspect, the maximum camber position ratio (d/c) monotonically increases from minimum at the blade root (21) to maximum at the intermediate blade cross section (33*a*).

According to an eighth aspect of the present disclosure, in each of the blades (20) of the sixth or the seventh aspect, the distance from the blade root (21) to the intermediate blade cross section (33*a*) is longer than the distance from the blade end (22) to the intermediate blade cross section (33*a*).

In each blade (20) of the propeller fan (10) of the eighth aspect, the intermediate blade cross section (33*a*) is located closer to the blade end (22) than to the center between the blade root (21) and the blade end (22). In this intermediate reference blade cross section (33*a*), the maximum camber position ratio (d/c) becomes minimum.

According to a ninth aspect of the present disclosure, in any one of the first to eighth aspects, in each of the blades (20), the maximum value of the camber in the blade cross section is set as a maximum camber (f), a ratio of the maximum camber (0 to the chord length (c) in the blade cross section, the camber ratio (f/c) becomes maximum in the second reference blade cross section (33, 33*b*) between the blade root (21) and the blade end (22), monotonically decreases from the second reference blade cross section (33, 33*b*) toward the blade root (21), and monotonically decreases in the direction from the second reference blade cross section (33, 33*b*) toward the blade end (22)

According to a tenth aspect of the present disclosure, each of the blades (20) in any one of the second to fifth aspects is configured such that a maximum value of the camber in the blade cross section is set as a maximum camber (0, that a ratio of the maximum camber (f) to the chord line length (c) in the blade cross section is set as a camber ratio (f/c), that the camber ratio (f/c) becomes maximum in the second reference blade cross section (33, 33*b*) located between the blade root (21) and the blade end (22), monotonically decreases in the direction from the second reference blade cross section (33, 33*b*) toward the blade root (21), and monotonically decreases in the direction from the second reference blade cross section (33, 33*b*) toward the blade end (22), and that the first reference blade cross section serves as the second reference blade cross section.

In each of the blades (20) provided to the propeller fan (10) according to the ninth and tenth aspects, the camber ratio (f/c) becomes maximum in the second reference blade cross section (33, 33*b*) separated from the blade root (21) by a predetermined distance. That is, in each blade (20), the camber ratio (f/c) monotonically decreases in the direction from the second reference blade cross section (33,33*b*) toward the blade root (21) and from the second reference blade cross section (33, 33*b*) toward the blade end (22).

The phrase "monotonically decrease" described in this specification means "weakly decrease". Accordingly, in each blade (20), the camber ratio (f/c) may continuously decrease from the second reference blade cross section (33, 33*b*) toward the blade end (22), or may be constant in some sections between the second reference blade cross section (33, 33*b*) and the blade end (22).

The area of the blade root (21) of the blade (20) is in the vicinity of the hub (15), so that turbulence of airflow tends to occur. On the other hand, in each blade (20) of the propeller fan (10) of the ninth and tenth aspects, the camber ratio (f/c) monotonically decreases in the direction from the second reference blade cross section (33, 33*b*) toward the blade root (21). That is, the camber ratio (f/c) is smaller in the vicinity of the blade root (21) of the blade (20) where turbulence of airflow tends to occur than in the second reference blade cross section (33, 33*b*). Therefore, turbulence of airflow in the vicinity of the blade root (21) of each blade (20) is suppressed, and energy consumed by the disturbance is reduced. As a result, fan efficiency is improved.

Further, in each blade (20) of the propeller fan (10) of each of the ninth and tenth aspects, the camber ratio (f/c) monotonically decreases in the direction from the second reference blade cross section (33, 33*b*) toward the blade end (22). That is, in each blade (20), the camber ratio (f/c) monotonically decreases in the direction from the second reference blade cross section (33,33*b*) toward the blade end (22) where the circumferential speed is faster than that of the second reference blade cross section (33, 33*b*). Therefore, the work amount of the blade (20) (specifically, the lift force applied to the blades (20)) is averaged over the entire blade (20), so that the fan efficiency is improved.

Furthermore, in each blade (20) of the propeller fan (10) of the tenth aspect, the first reference blade cross section and the second reference blade cross section coincide with each other. That is, in each blade (20) of the propeller fan (10), the maximum camber position ratio (d/c) becomes minimum and the camber ratio (f/c) becomes maximum in one blade cross section, which is separated from the blade root (21) by a predetermined distance.

In an eleventh aspect of the present disclosure, each of the blades (20) according to the ninth aspect or the tenth aspect is configured such that the camber ratio (f/c) at the blade end (22) is smaller than the camber ratio (f/c) at the blade root (21).

Here, in each blade (20) of the propeller fan (10), the circumferential speed of the blade end (22) is higher than that of the blade root (21). Therefore, when the camber ratio (f/c) at the blade end (22) is approximately equal to the camber ratio (f/c) at the blade root (21), the air differential pressure between the positive pressure surface (25) side and the negative pressure surface (26) side near the blade end (22) of each blade (20) becomes too large, resulting in that the flow rate of air flowing from the positive pressure surface (25) side to the negative pressure surface (26) side via the blade end (22) of a blade (20) may increase, thereby causing decrease in fan efficiency.

In contrast, in each blade (20) of the propeller fan (10) of the eleventh aspect, the camber ratio (f/c) at the blade end (22) is smaller than the camber ratio (f/c) at the blade root (21). Therefore, the air differential pressure between the positive pressure surface (25) side and the negative pressure surface (26) side in the vicinity of the blade end (22) of each blade (20) is suppressed to an extent which is not excessively large. As a result, the flow rate of air flowing back from the positive pressure side (25) side to the negative pressure surface (26) side via the blade end (22) of each blade (20) can be reduced, thereby improving fan efficiency. Further, the blade end vortex (90) generated in the vicinity of the blade end (22) is suppressed, so that energy consumed to generate the blade end vortex (90) is reduced, which also results in that the fan efficiency is improved.

Advantages of the Invention

In the first aspect described above, in each blade (20) of the propeller fan (10), the maximum camber position ratio (d/c) at the blade end (22) is larger than the maximum camber position ratio (d/c) at the blade root (21). Therefore, the development of the blade end vortex (90) is suppressed and the blade end vortex (90) is shortened so that energy consumed for the generation of the blade end vortex (90) is reduced. As a result, according to this aspect, the efficiency can be improved by reducing the loss of power of driving the propeller fan (10) to rotate.

According to the second aspect described above, in each blade (20) of the propeller fan (10), the maximum camber position ratio (d/c) monotonically increases from the first reference blade cross section (33) toward the blade end (22), and becomes maximum at the blade end (22). Therefore, the development of the blade end vortex (90) is suppressed and the blade end vortex (90) is shortened so that energy consumed for the generation of the blade end vortex (90) is reduced. As a result, according to this aspect, the efficiency can be improved by reducing the loss of power of driving the propeller fan (10) to rotate.

According to the ninth aspect described above, in each blade (20) of the propeller fan (10), the camber ratio (f/c) becomes maximum in the second reference blade cross section (33, 33*b*) located between the blade root (21) and the blade end (22), and monotonically decreases in the direction from the second reference blade cross section (33, 33*b*) toward the blade root (21) and monotonically decreases in the direction from the second reference blade cross section (33, 33*b*) toward the blade end (22). Therefore, turbulence of airflow in the vicinity of the blade root (21) of each blade (20) can be suppressed, and the work amount of each blade (20) can be averaged over the entire blade (20). Therefore, according to this aspect, the loss of power of driving the fan to rotate can be further reduced, and fan efficiency can be further improved.

In each blade (20) of the propeller fan (10) of the eleventh aspect described above, the camber ratio (f/c) at the blade end (22) is smaller than the camber ratio (f/c) at the blade root (21). Therefore, it is possible to reduce the flow rate of air flowing from the positive pressure surface (25) side to the negative pressure surface (26) side via the blade end (22) of the blade (20), and the blade end vortex (90) generated in the vicinity of the blade end (22) can be suppressed. Therefore, according to this aspect, the loss of power of driving the fan to rotate can be further reduced, and fan efficiency can be further improved.

DESCRIPTION OF EMBODIMENTS

Embodiments of the present invention will be described in detail with reference to the drawings. Note that the following embodiments and variations are merely beneficial examples in nature, and are not intended to limit the scope, applications, or use of the invention.

First Embodiment

The first embodiment will be described. A propeller fan (10) of this embodiment is configured as an axial fan. The propeller fan (10) is provided, for example, in a heat source unit of an air conditioner, and is used to supply outdoor air to a heat-source-side heat exchanger.

Propeller Fan Configuration

Figure 1:
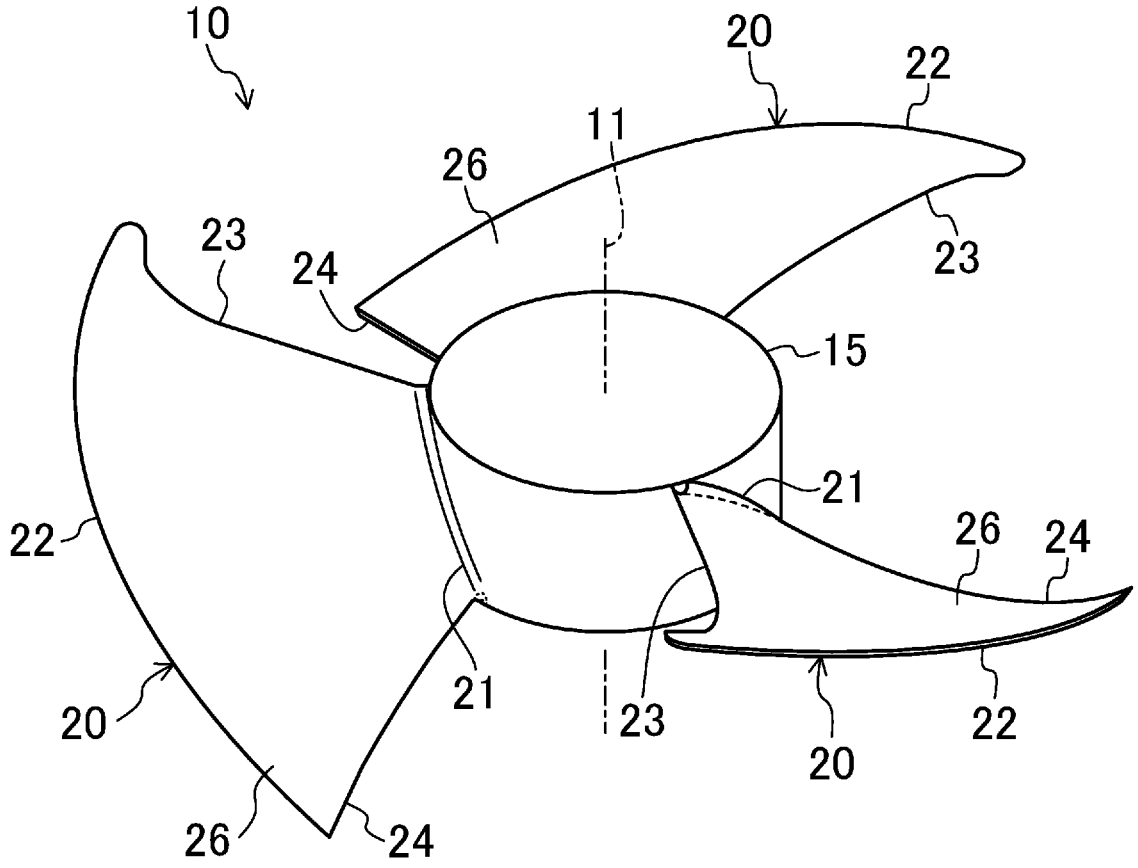
FIG. 1 is a perspective view of a propeller fan of a first embodiment.
Figure 2:
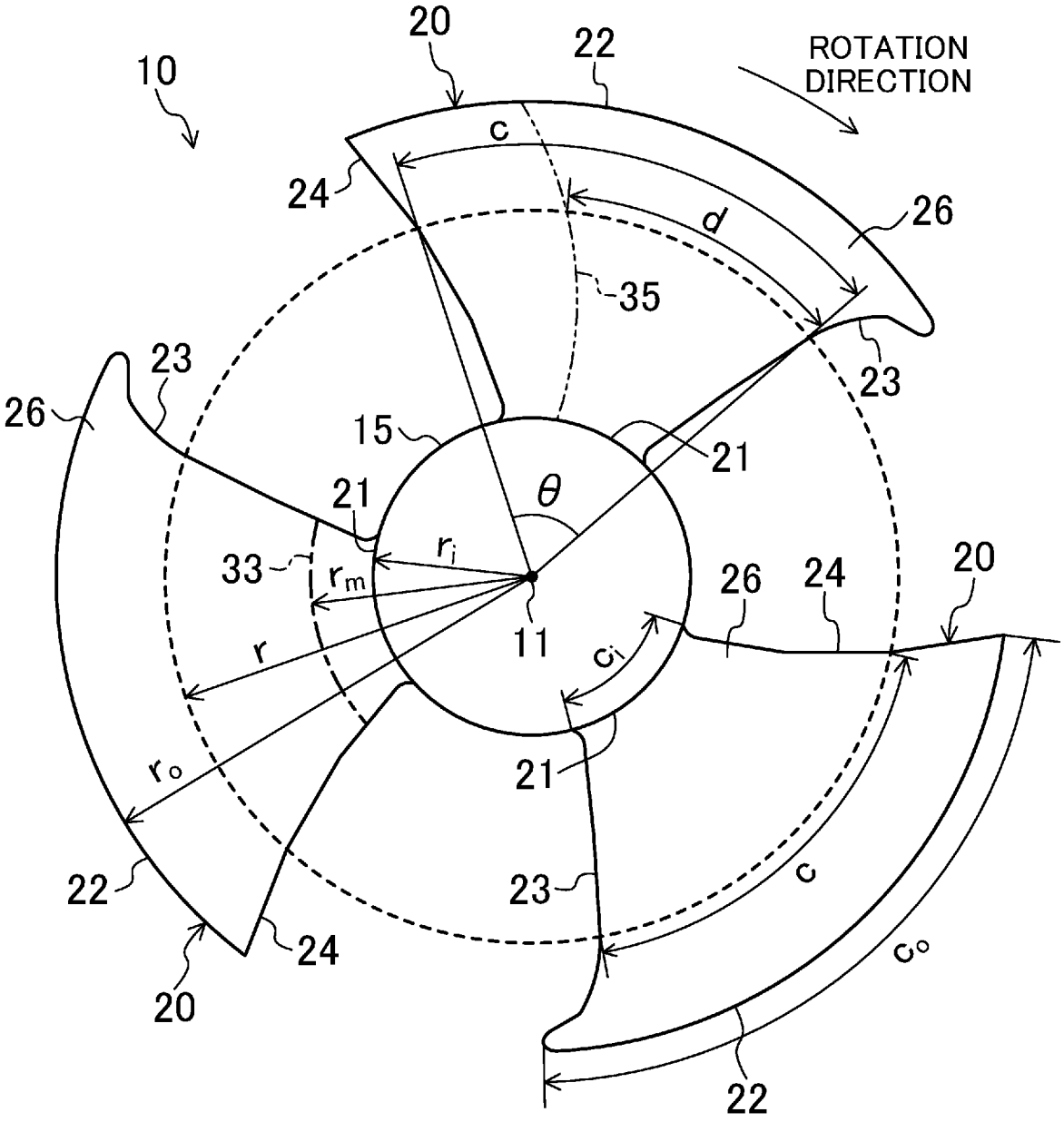
FIG. 2 is a plan view of the propeller fan of the first embodiment.

As shown in FIG. 1 and FIG. 2, the propeller fan (10) of this embodiment includes one hub (15) and three blades (20). The hub (15) and the three blades (20) are integrally formed. The propeller fan (10) is made of a resin.

The hub (15) is formed into a shape of a cylinder whose tip end face (upper surface shown in FIG. 1) is closed. The hub (15) is attached to a drive shaft of a fan motor. The center axis of the hub (15) is a rotational center axis (11) of the propeller fan (10).

Each blade (20) is arranged to project outwardly from the outer peripheral surface of the hub (15). The three blades (20) are arranged at regular angular intervals in the circumferential direction of the hub (15). Each blade (20) has a shape extending toward the outside in the radial direction of the propeller fan (10). The blades (20) have the identical shape.

The blade (20) is configured such that an end portion on a radial center side (i.e., a hub (15) side) of the propeller fan (10) is a blade root (21), and an outer end portion in a radial direction of the propeller fan (10) is a blade end (22). The blade root (21) of each blade (20) is joined to the hub (15). The distance $r_i$ from the rotational center axis (11) to the blade root (21) of the propeller fan (10) is substantially constant over the entire length of the blade root (21). The distance $r_o$ from the rotational center axis (11) to the blade end (22) of the propeller fan (10) is also substantially constant over the entire length of the blade end (22).

The blade (20) is configured such that a front edge in the rotation direction of the propeller fan (10) is a leading edge (23), and a rear edge in the rotation direction of the propeller fan (10) is a trailing edge (24). The leading edge (23) and the trailing edge (24) of the blade (20) extend from the blade root (21) toward the blade end (22) and thus extend toward the outer circumferential side of the propeller fan (10).

The blade (20) is inclined with respect to a plane orthogonal to the rotational center axis (11) of the propeller fan (10). Specifically, the blade (20) is arranged such that the leading edge (23) is located near a tip end (upper end shown in FIG. 1) of the hub (15), and the trailing edge (24) is located near a base end (lower end shown in FIG. 1) of the hub (15). The blade (20) is configured such that a front surface (a downward face in FIG. 1) in the rotation direction of the propeller fan (10) is a positive pressure surface (25), and a rear surface (an upward face in FIG. 1) in the rotation direction of the propeller fan (10) is a negative pressure surface (26).

Detailed Shape of Blades

Hereinafter, the shape of the blade (20) will be described in detail.

Figure 3:
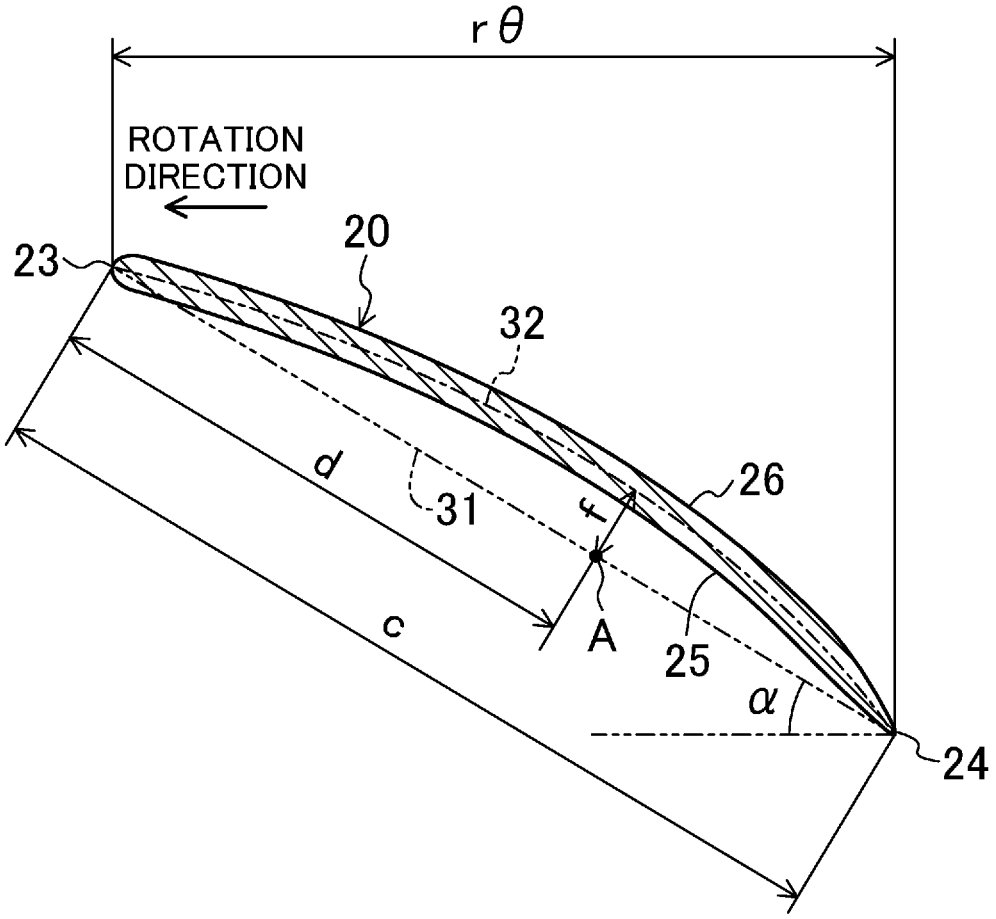
FIG. 3 is a cross-sectional view of a blade cross section of a blade of the propeller fan of the first embodiment.

The blade cross section shown in FIG. 3 is a planer view of a cross section, of a blade (20), located at a distance r from a rotational center axis (11) of a propeller fan (10). As shown in FIG. 3, the blade (20) is cambered so as to bulge toward the negative pressure surface (26) side.

In the blade cross section shown in FIG. 3, a line segment connecting the leading edge (23) and the trailing edge (24) is a chord line (31), and an angle formed by the chord line (31) with a "plane orthogonal to the rotational center axis (11) of the propeller fan (10)" is an attaching angle $\alpha$. The chord length c is a value obtained through dividing the arc length $r\theta$ having an arc radius r and a central angle $\theta$ by a cosine $\cos\alpha$ with respect to the attaching angle $\alpha$ ($c=r\theta/\cos\alpha$). Note that $\theta$ is a central angle of the blade (20) at the position located with the distance r from the rotational center axis (11) of the propeller fan (10) (see FIG. 2), and the unit thereof is radian.

In the blade cross section shown in FIG. 3, a line connecting the midpoints of the positive pressure surface (25) and the negative pressure surface (26) is a mean line (32), and the distance from the chord line (31) to the mean line (32) is a camber. The camber gradually increases in the direction from the leading edge (23) to the trailing edge (24) along the chord line (31), becomes maximum halfway between the leading edge (23) and the trailing edge (24), and gradually decreases in the direction from the position, at which the camber becomes maximum, toward the trailing edge (24). The maximum value of the camber is the maximum camber f, and the position on the chord line (31) where the camber reaches the maximum camber f is the maximum camber position A. Further, the distance from the leading edge (23) to the maximum camber position (A) is represented by d.

Camber Ratio

Figure 4:
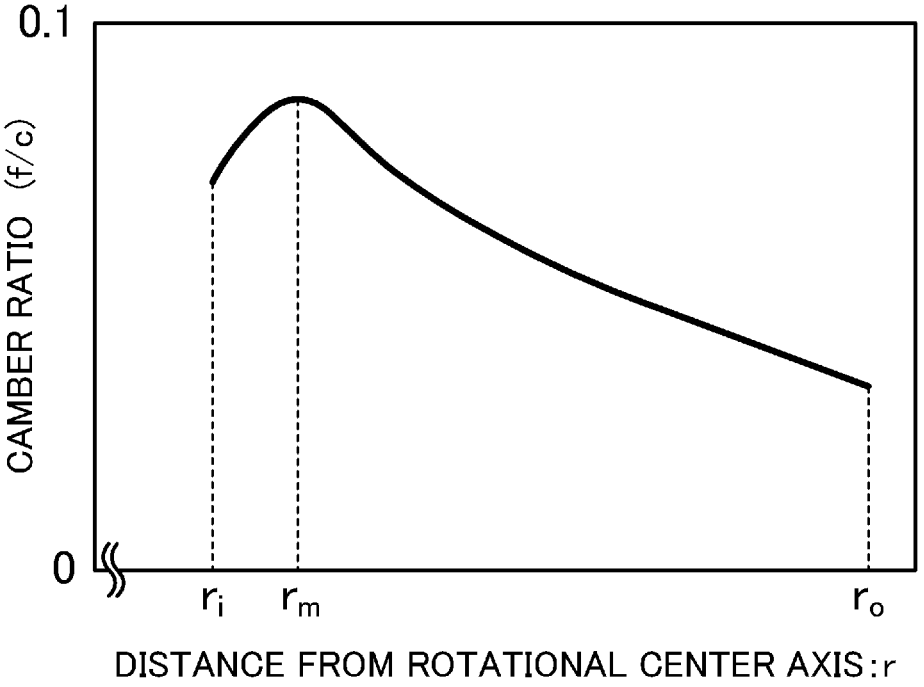
FIG. 4 is a graph showing a relationship between a distance r from the rotational center axis and the camber ratio (f/c) of the blade of the propeller fan of the first embodiment.

As shown in FIG. 4, in the blade (20) of this embodiment, the camber ratio (f/c), which is the ratio of the maximum camber f to the chord length c in the blade cross section, varies in accordance with the distance from the rotational center axis (11) of the propeller fan (10). This camber ratio (f/c) varies on a way from the blade root (21) to the blade end (22) such that the camber ratio becomes relative maximum only once and never becomes relative minimum.

Specifically, the camber ratio (f/c) becomes maximum value ($f_m/c_m$) in the reference blade cross section (33)

located between the blade root (21) and the blade end (22). Note that $f_m$ is the maximum camber in the reference blade cross section (33), and $c_m$ is the chord length in the reference blade cross section (33) (see FIG. 6B).

The camber ratio (f/c) gradually decreases in the direction from the reference blade cross section (33) toward the blade root (21), and gradually decreases in the direction from the reference blade cross section (33) toward the blade end (22). That is, when $r_i \leq r \leq r_m$, the camber ratio (f/c) becomes smaller as the distance r becomes shorter, and when $r_m \leq r \leq r_o$, the camber ratio (f/c) becomes smaller as the distance r becomes longer.

Here, the reference blade cross section (33) is a blade cross section at a position where the distance from the rotational center axis (11) of the propeller fan (10) is represented by $r_m$. That is, the reference blade cross section (33) is a blade cross section which is separated from the blade root (21) by a distance $(r_m - r_i)$. In this embodiment, the distance $(r_m - r_i)$ from the blade root (21) to the reference blade cross section (33) is about 10% (i.e., about 1/10) of the distance $(r_o - r_i)$ from the blade root (21) to the blade end (22). That is, the reference blade cross section (33) is located closer to the blade root (21) than to the center between the blade root (21) and the blade end (22) in the radial direction of the propeller fan (10).

The distance $(r_m - r_i)$ from the blade root (21) to the reference blade cross section (33) is preferably 5% to 30% of the distance $(r_o - r_i)$ from the blade root (21) to the blade end (22), more preferably 5% to 20% of the distance $(r_o - r_i)$ from the blade root (21) to the blade end (22), and yet more preferably 5% to 10% of the distance $(r_o - r_i)$ from the blade root (21) to the blade end (22).

In the blade (20) of this embodiment, the camber ratio $(f_o/c_o)$ at the blade end (22) is smaller than the camber ratio WO at the blade root (21). Specifically, the camber ratio $(f_o/c_o)$ at the blade end (22) is substantially the half of the camber ratio $(f_i/c_i)$ at the blade root (21). The camber ratio $(f_o/c_o)$ at the blade end (22) is preferably set to be equal to or less than the half of the camber ratio $(f_i/c_i)$ at the blade root (21) and greater than or zero. Note that $f_i$ is the maximum camber at the blade root (21), and $c_i$ is the chord length at the blade root (21) (see FIG. 6A). Further, $f_o$ is the maximum camber at the blade end (22), and $c_o$ is the chord length at the blade end (22) (see FIG. 6C).

Maximum Camber Position Ratio

Figure 5:
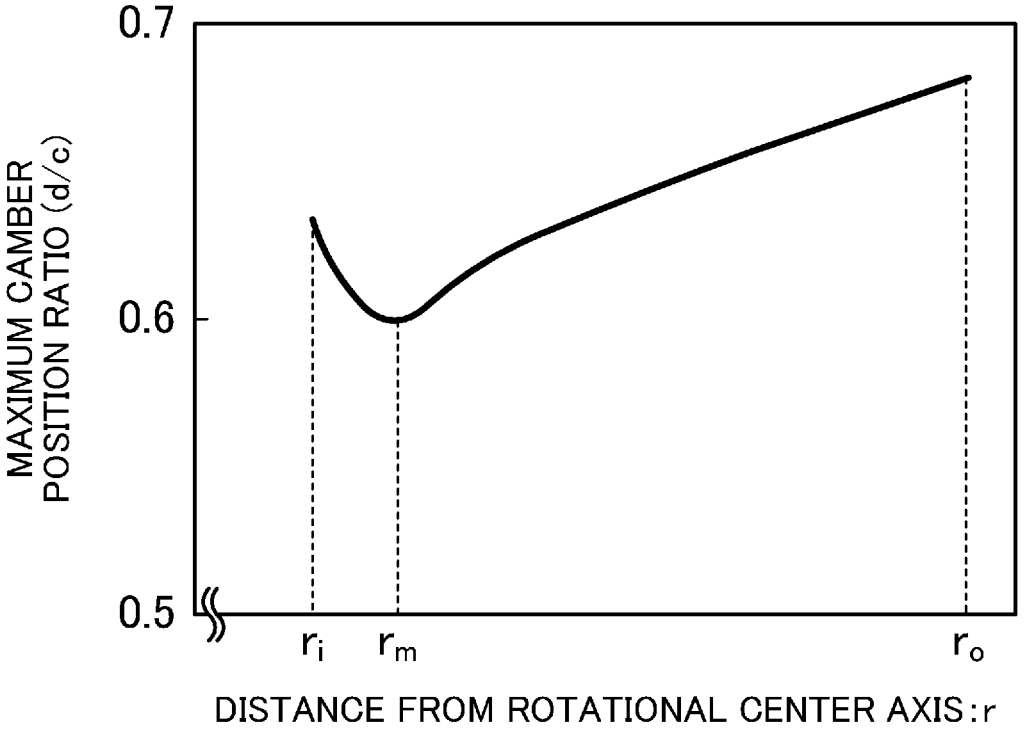
FIG. 5 is a graph showing a relationship between the distance r from the rotational center axis and the maximum camber position ratio (d/c) of the blade of the propeller fan of the first embodiment.

As shown in FIG. 5, in the blade (20) of this embodiment, the maximum camber position ratio (d/c), which is the ratio of the distance d between the leading edge (23) and the maximum camber position A to the chord length c, varies in accordance with the distance from the rotational center axis (11) of the propeller fan (10). The maximum camber position ratio (d/c) varies on a way from the blade root (21) to the blade end (22) such that the maximum camber position ratio becomes relative minimum only once and never becomes relative maximum.

Specifically, the maximum camber position ratio (d/c) reaches the minimum value $(d_m/c_m)$ in the reference blade cross section (33) located between the blade root (21) and the blade end (22). Note that $d_m$ is the distance from the leading edge (23) to the maximum camber position A in the reference blade cross section (33) (see FIG. 6B).

Further, the maximum camber position ratio (d/c) gradually increases in the direction from the reference blade cross section (33) toward the blade root (21), and gradually increases in the direction from the reference blade cross section (33) toward the blade end (22). That is, when $r_i \leq r \leq r_m$, the maximum camber position ratio (d/c) becomes larger as the distance r becomes shorter, and when $r_m \leq r \leq r_o$, the maximum camber position ratio (d/c) becomes larger as the distance r becomes longer. As the maximum camber position ratio (d/c) increases, the maximum camber position A moves relatively farther away from the leading edge (23), and the maximum camber position A becomes relatively closer to the trailing edge (24). A maximum camber position line (35) connecting the maximum camber positions A in the blade cross section, which are respectively positioned at certain distances from the rotational center axis (11) of the propeller fan (10), is indicated by a long dashed double-short dashed line in FIG. 2.

In this embodiment, the maximum camber position ratio (d/c) reaches the minimum value and the camber ratio (f/c) reaches the maximum value in the reference blade cross section (33). In other words, in this embodiment, the first reference blade cross section at which the maximum camber position ratio (d/c) reaches the minimum value coincides with the second reference blade cross section at which the camber ratio (f/c) reaches the maximum value.

In the blade (20) of this embodiment, the maximum camber position ratio (d/c) reaches the maximum value $(d_o/c_o)$ at the blade end (22). That is, in the blade (20) of this embodiment, the maximum camber position ratio $(d_o/c_o)$ at the blade end (22) is larger than the maximum camber position ratio $(d_i/c_i)$ at the blade root (21). Note that $d_i$ is a distance from the leading edge (23) to the maximum camber position A in the blade root (21) (see FIG. 6A), and $d_o$ is a distance from the leading edge (23) to the maximum camber position A in the blade end (22) (see FIG. 6C).

In the blade (20) of this embodiment, the maximum camber position ratio (d/c) is set to a value equal to or greater than 0.6 and equal to or smaller than 0.7 in all the blade cross sections. It is preferable that the maximum camber position ratio (d/c) is set to a value equal to or greater than 0.5 and equal to or smaller than 0.8.

Attaching Angle

Figure 6A:
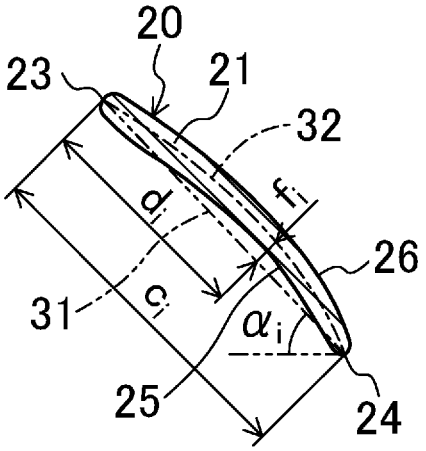
FIG. 6A is a cross-sectional view of the blade showing a blade cross section of a blade root of the blade of the propeller fan of the first embodiment.
Figure 6B:
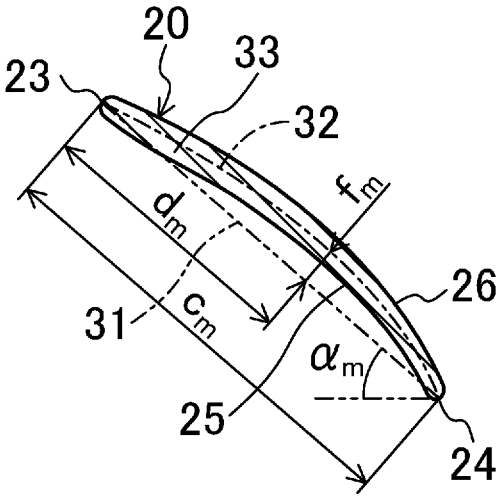
FIG. 6B is a cross-sectional view of the blade showing a reference blade cross section of the blade of the propeller fan of the first embodiment.
Figure 6C:
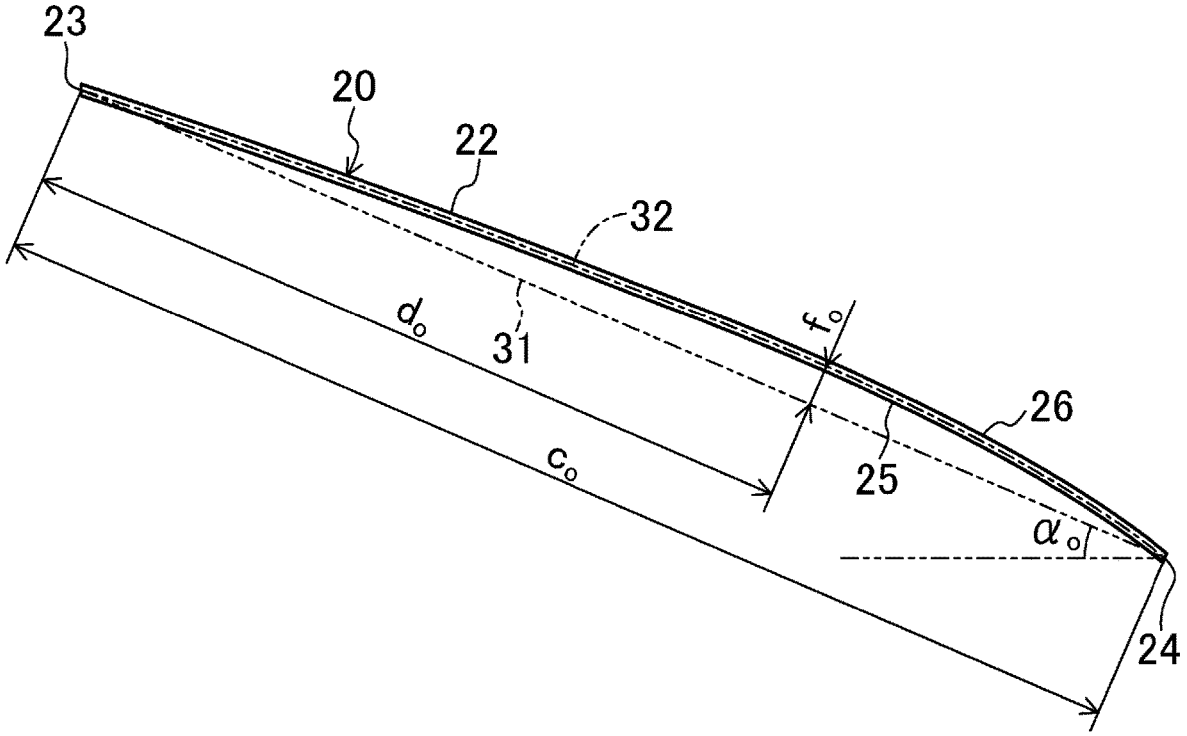
FIG. 6C is a cross-sectional view of the blade showing a blade cross section of a blade end of the blade of the propeller fan the first embodiment.

As shown in FIG. 6A to FIG. 6C, in the blade (20) of this embodiment, the attaching angle $\alpha$ gradually decreases in the direction from the blade root (21) toward the blade end (22). That is, the attaching angle $\alpha$ becomes smaller as the blade cross section is farther away from the rotational center axis (11) of the propeller fan (10). Therefore, in the blade (20) of this embodiment, the attaching angle $\alpha_i$ at the blade root (21) reaches the maximum value, and the attaching angle $\alpha_o$ at the blade end (22) reaches the minimum value.

Blowing Effect of Propeller Fan

The propeller fan (10) of this embodiment is driven by a fan motor connected to a hub (15), and rotates in the clockwise direction of FIG. 2. When the propeller fan (10) rotates, air is pushed out in the direction of the rotational center axis (11) of the propeller fan (10) by the blades (20).

In each blade (20) of the propeller fan (10), the air pressure on the positive pressure surface (25) side becomes higher than the atmospheric pressure, and the air pressure on the negative pressure surface (26) side becomes lower than the atmospheric pressure. Therefore, lift force is applied to each of the blades (20) of the propeller fan (10). The lift force pushes the blades (20) in the direction from the positive pressure surface (25) toward the negative pressure surface (26). The lift force is a reaction force for the force with which each of the blades (20) of the propeller fan (10) pushes out air. Accordingly, the larger the lift force applied to the blades (20), the larger the work amount of the blades (20) pushing out air.

Relationship of the Camber Ratio to Airflow

The region in the vicinity of the blade root (21) of the blade (20) in the propeller fan (10) is the vicinity of the hub (15), so that turbulence of airflow tends to occur. On the other hand, in each blade (20) of the propeller fan (10) of this embodiment, the camber ratio (f/c) gradually decreases in the direction from the reference blade cross section (33) toward the blade root (21). That is, the camber ratio (f/c) is smaller in a region in the vicinity of the blade root (21) of the blade (20) where turbulence of airflow tends to occur than in the reference blade cross section (33). Therefore, turbulence of airflow in the vicinity of the blade root (21) of each blade (20) is suppressed, and energy consumed by the disturbance is reduced. As a result, fan efficiency is improved, and power consumption of the fan motor driving the propeller fan (10) is reduced.

In addition, in each blade (20) of the propeller fan (10) of this embodiment, the camber ratio (f/c) gradually decreases in the direction from the reference blade cross section (33) toward the blade end (22). That is, in each blade (20), the camber ratio (f/c) gradually decreases in the direction from the reference blade cross section (33) toward the blade end (22) where the circumferential speed is faster than that of the reference blade cross section (33). Therefore, the work amount of the blade (20) (specifically, the lift force applied to the blades (20)) is averaged over the entire blade (20), so that the fan efficiency is improved.

Here, in each blade (20) of the propeller fan (10), the circumferential speed of the blade end (22) is higher than that of the blade root (21). Therefore, when the camber ratio ($f_o/c_o$) at the blade end (22) is approximately equal to the camber ratio ($f_i/c_i$) at the blade root (21), the air differential pressure between the positive pressure surface (25) side and the negative pressure surface (26) side near the blade end (22) of each blade (20) becomes too large, resulting in that the flow rate of air flowing from the positive pressure surface (25) side to the negative pressure surface (26) side via the blade end (22) of a blade (20) may increase, thereby causing decrease in fan efficiency.

On the other hand, in each blade (20) of the propeller fan (10) of this embodiment, the camber ratio ($f_o/c_o$) at the blade end (22) is approximately the half of the camber ratio ($f_i/c_i$) at the blade root (21). Therefore, the air differential pressure between the positive pressure surface (25) side and the negative pressure surface (26) side in the vicinity of the blade end (22) of each blade (20) is suppressed to an extent which is not excessively large. As a result, the flow rate of air flowing back from the positive pressure side (25) side to the negative pressure surface (26) side via the blade end (22) of each blade (20) can be reduced, thereby improving fan efficiency. Further, the blade end vortex (90) generated in the vicinity of the blade end (22) is suppressed, so that energy consumed to generate the blade end vortex (90) is reduced, which also results in that the fan efficiency is improved.

Relationship Between Maximum Camber Position Ratio to Airflow

Figure 8:
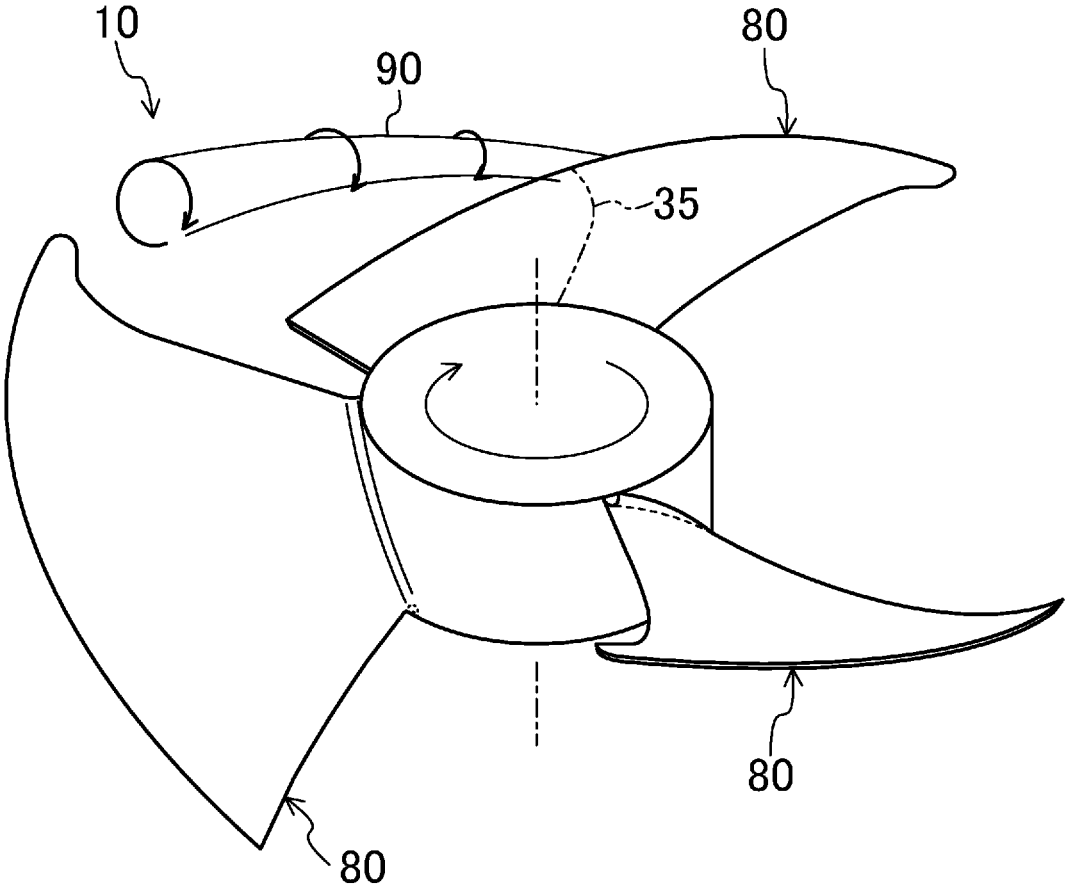
FIG. 8 is a perspective view of a conventional propeller fan showing an airflow on the conventional propeller fan

In the blade (20) of the propeller fan (10), a blade end vortex (90) is generated in the vicinity of a position where the camber becomes maximum at the blade end (22). As shown in FIG. 8, as the generation position of the blade end vortex (90) approaches to the leading edge (23) of the blade (80), the blade end vortex (90) becomes longer, and energy consumed for the generation of the blade end vortex (90) increases.

Figure 7:
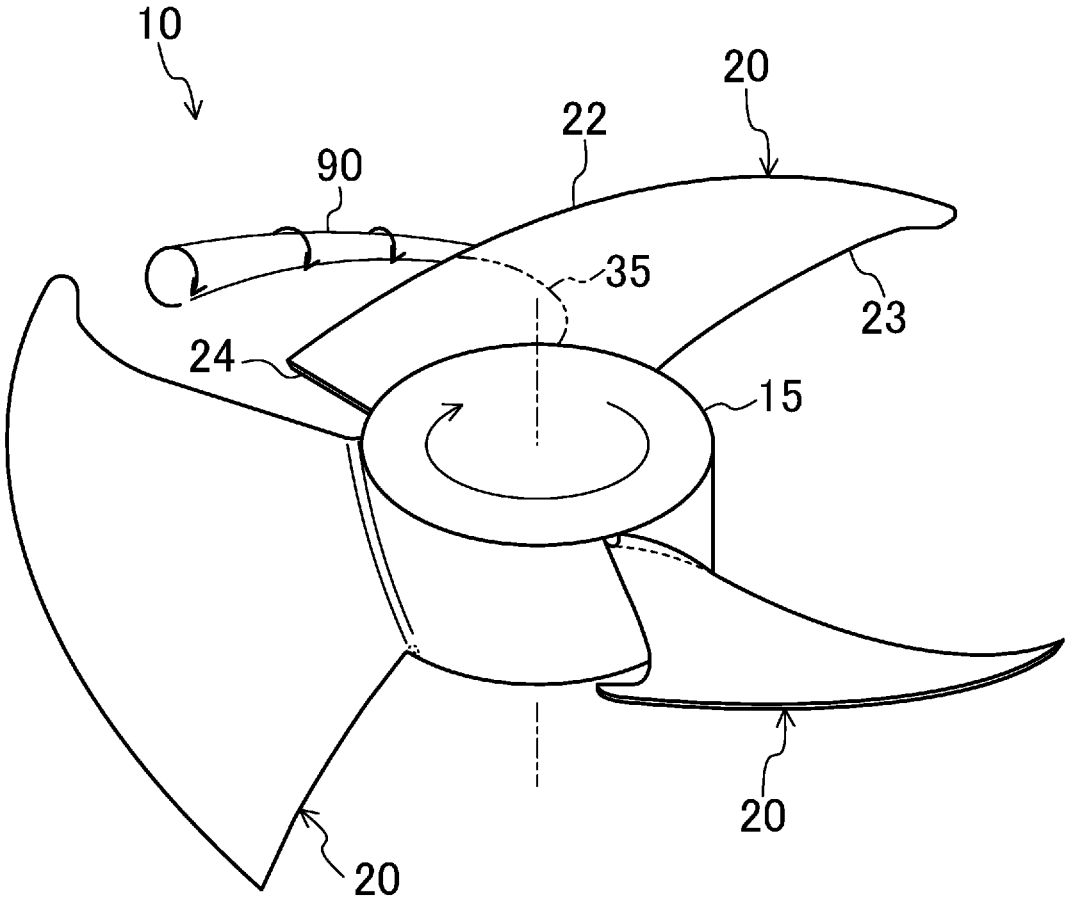
FIG. 7 is a perspective view of a propeller fan showing an airflow on the propeller fan of the first embodiment

On the other hand, in each blade (20) of the propeller fan (10) of this embodiment, the maximum camber position ratio (d/c) gradually increases in the direction from the reference blade cross section (33) toward the blade end (22). That is, in each blade (20), the maximum camber position A at which the camber becomes maximum in the blade cross section becomes relatively closer to the trailing edge (24) of the blade (20) in the direction from the reference blade cross section (33) toward the blade end (22). As shown in FIG. 7, the position where the blade end vortex (90) is generated in the blade (20) of this embodiment is closer to the trailing edge (24) of the blade (20) than that in the conventional blade (80) shown in FIG. 8. Therefore, the development of the blade end vortex (90) is suppressed and the blade end vortex (90) is shortened so that energy consumed for the generation of the blade end vortex (90) is reduced. As a result, fan efficiency is improved, and power consumption of the fan motor driving the propeller fan (10) is reduced.

Here, there is a case where the airflow flowing from the leading edge (23) to the trailing edge (24) along the negative pressure surface (26) of the blade (20) separates from the negative pressure surface (26) of the blade (20) in the vicinity of the region where the airflow just passes by the maximum camber position A. Therefore, if the maximum camber position A is too close to the leading edge (23), the region where the airflow separates from the negative pressure surface (26) of the blade (20) is enlarged, which may lead to increase in blowing sound and decrease in fan efficiency. In order to avoid this problem, it is desirable to set the maximum camber position ratio (d/c) to a value equal to or greater than 0.5. In view of the above, in the blade (20) of this embodiment, the maximum camber position ratio (d/c) is set to equal to or greater than 0.6.

When the maximum camber position A is too close to the trailing edge (24), the shape of the blade cross section is sharply bent at a position near the trailing edge (24). Therefore, when the maximum camber position A is too close to the trailing edge (24), the airflow flowing along the negative pressure surface (26) of the blade (20) tends to separate from the negative pressure surface (26). When the airflow separates from the negative pressure surface (26) of the blade (20), there arises a possibility of increased blowing sound and decreased fan efficiency. In order to avoid this problem, it is desirable to set the maximum camber position ratio (d/c) to a value equal to or less than 0.8. In view of the above, in the blade (20) of this embodiment, the maximum camber position ratio (d/c) is set to equal to or less than 0.7.

As described above, in the blade (20) of this embodiment, the attaching angle $\alpha$ becomes larger in the blade cross section located closer to the blade root (21). The larger the attaching angle $\alpha$ is, the more easily airflow flowing along the negative pressure surface (26) of the blade (20) separates from the negative pressure surface (26). On the other hand, when the maximum camber position ratio (d/c) is substantially equal to or greater than 0.5, the smaller the maximum camber position ratio (d/c) is (i. e., the closer the maximum camber position A is to the leading edge (23)), the less likely airflow flowing along the negative pressure surface (26) of the blade (20) separates from the negative pressure surface (26). Therefore, in the blade (20) of this embodiment, in the region between the blade end (22) and the reference blade cross section (33), the maximum camber position ratio (d/c)

gradually decreases as the reference blade cross section gets closer to the blade root (21) (i. e., as the attaching angle $\alpha$ increases), thereby making it difficult for the airflow from separating from the negative pressure surface (26) of the blade (20).

Advantages of First Embodiment

In each blade (20) of the propeller fan (10) of this embodiment, the maximum camber position ratio (d/c) gradually increases from the reference blade cross section (33) to the blade end (22), and becomes maximum at the blade end (22). Therefore, the development of the blade end vortex (90) is suppressed and the blade end vortex (90) is shortened so that energy consumed for the generation of the blade end vortex (90) is reduced. As a result, according to this embodiment, fan efficiency can be improved by reducing the loss of power of driving the fan to rotate, and the power consumption of the fan motor driving the propeller fan (10) can be reduced.

In each blade (20) of the propeller fan (10) of this embodiment, the maximum camber position ratio (d/c) is set to equal to or greater than 0.5 to equal to or less than 0.8. Therefore, the airflow is less likely to separate from the negative pressure surface (26) of the blade (20), so that the increase in air blowing sound caused by the airflow detached and the reduction in fan efficiency can be avoided.

In each blade (20) of the propeller fan (10) of this embodiment, the camber ratio (f/c) becomes maximum in the reference blade cross section (33), gradually decreases in the direction from the reference blade cross section (33) toward the blade root (21), and gradually decreases in the direction from the reference blade cross section (33) toward the blade end (22). Therefore, turbulence of airflow in the vicinity of the blade root (21) of each blade (20) can be suppressed, and the work amount of each blade (20) can be averaged over the entire blade (20). Therefore, according to this embodiment, it is possible to further reduce the loss of power of driving the fan to rotate, and to further improve the fan efficiency.

Moreover, in each blade (20) of the propeller fan (10) of this embodiment, the camber ratio (f/c) at the blade end (22) is smaller than the camber ratio (f/c) at the blade root (21). Therefore, it is possible to reduce the flow rate of air flowing from the positive pressure surface (25) side to the negative pressure surface (26) side via the blade end (22) of the blade (20), and the blade end vortex (90) generated in the vicinity of the blade end (22) can be suppressed. Therefore, according to this embodiment, it is possible to further reduce the loss of power of driving the fan to rotate, and to further improve the fan efficiency.

First Variation of First Embodiment

Figure 9:
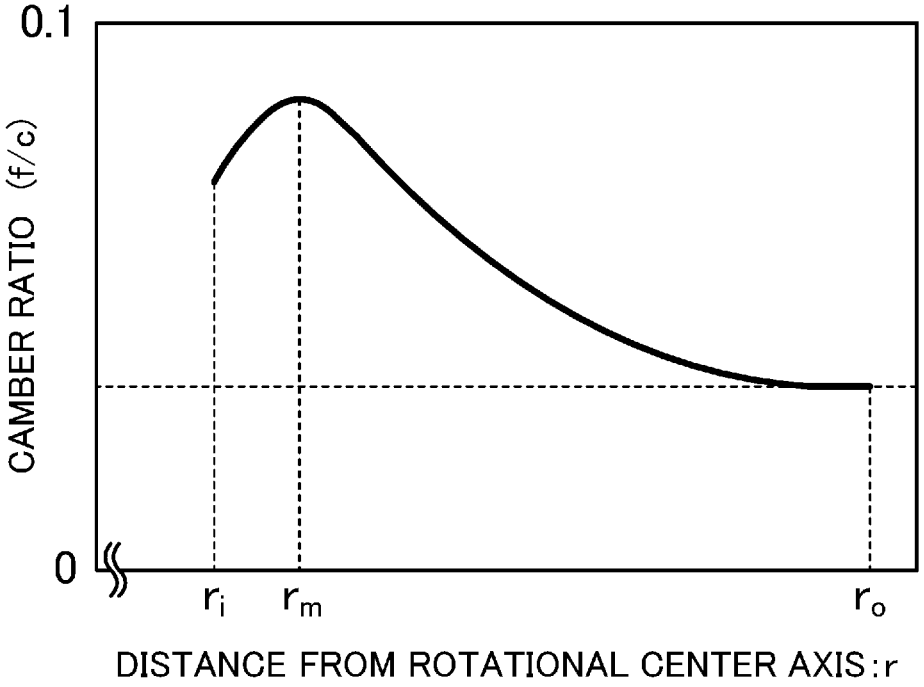
FIG. 9 is a graph showing a relationship between the distance r from the rotational center axis and the camber ratio (f/c) of the blade of the propeller fan of a first variation of the first embodiment.

In each blade (20) of the propeller fan (10) of this embodiment, there may be a section in which the camber ratio (f/c) is constant in one or both of: the region from the blade root (21) to the reference blade cross section (33); and the region from the reference blade cross section (33) to the blade end (22). For example, as shown in FIG. 9, the camber ratio (f/c) may be constant in a region extending from a position near the blade end (22) to the blade end (22) in the blade (20).

Second Variation of First Embodiment

Figure 10:
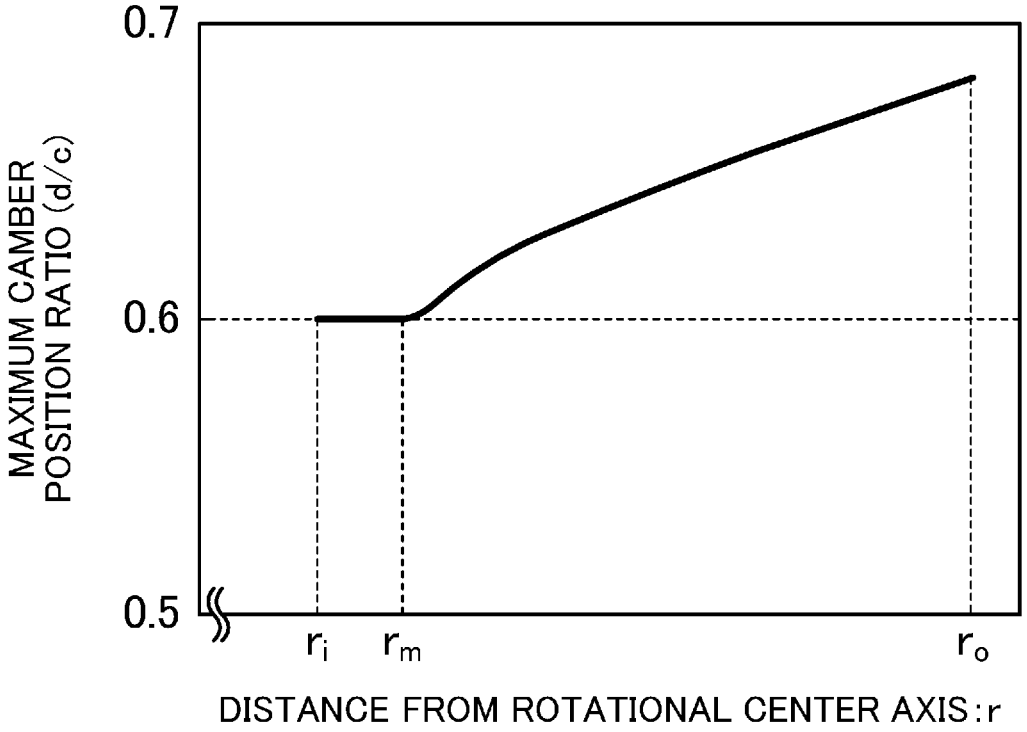
FIG. 10 is a graph showing a relationship between the distance r from the rotational center axis and the maximum camber position ratio (d/c) of the blade of the propeller fan of a second variation of the first embodiment.

In each blade (20) of the propeller fan (10) of this embodiment, there may be a section in which the maximum camber position ratio (d/c) is constant in one or both of: the region from the blade root (21) to the reference blade cross section (33); and the region from the reference blade cross section (33) to the blade end (22). Further, as shown in FIG. 10, the maximum camber position ratio (d/c) may be constant in a region extending from the blade root (21) to the reference blade cross section (33) in the blade (20). In this case, the maximum camber position ratio (d/c) has a minimum value in a region extending from the blade root (21) to the reference blade cross section (33) in the blade (20).

Second Embodiment

A second embodiment will be described. A propeller fan (10) of this embodiment is obtained by changing the shape of blades (20) of the propeller fan (10) of the first embodiment. The propeller fan (10) of this embodiment will be described mainly through explaining a difference between the propeller fan (10) of this embodiment and the propeller fan (10) of the first embodiment.

Figure 11:
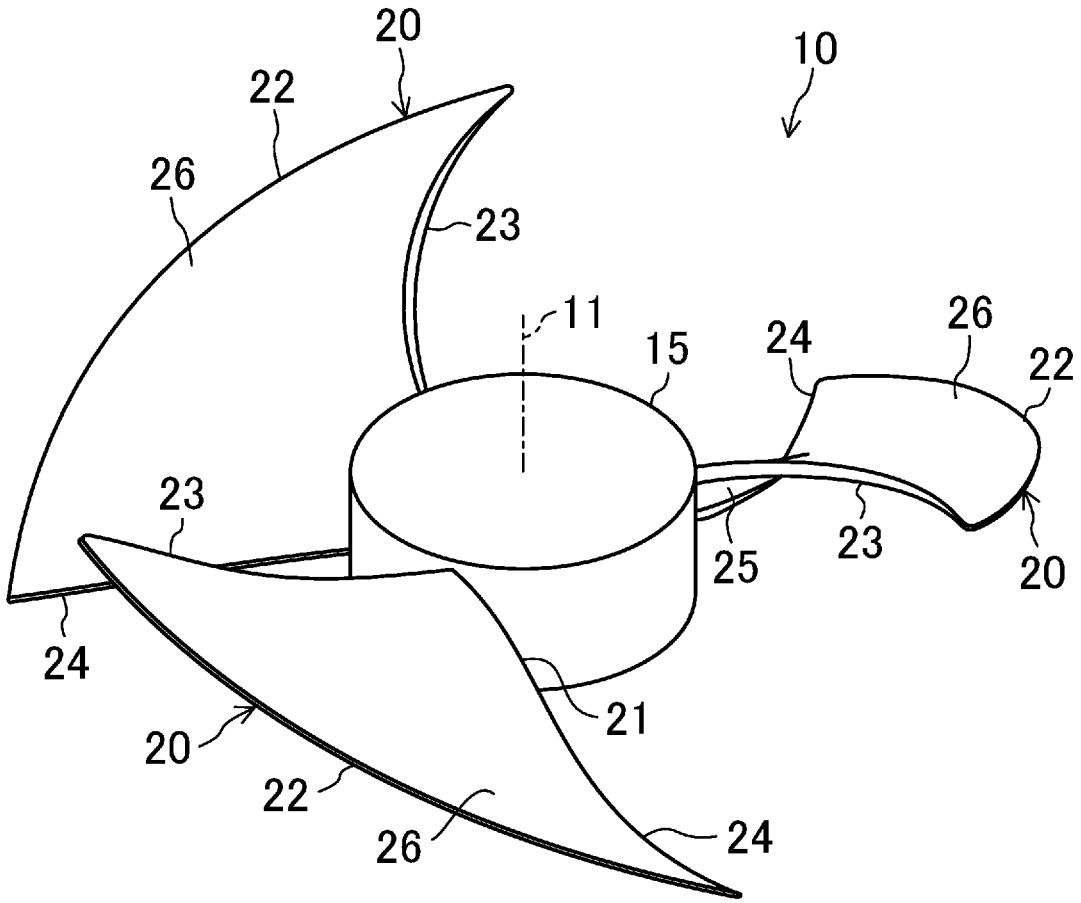
FIG. 11 is a perspective view of a propeller fan of a second embodiment.
Figure 12:
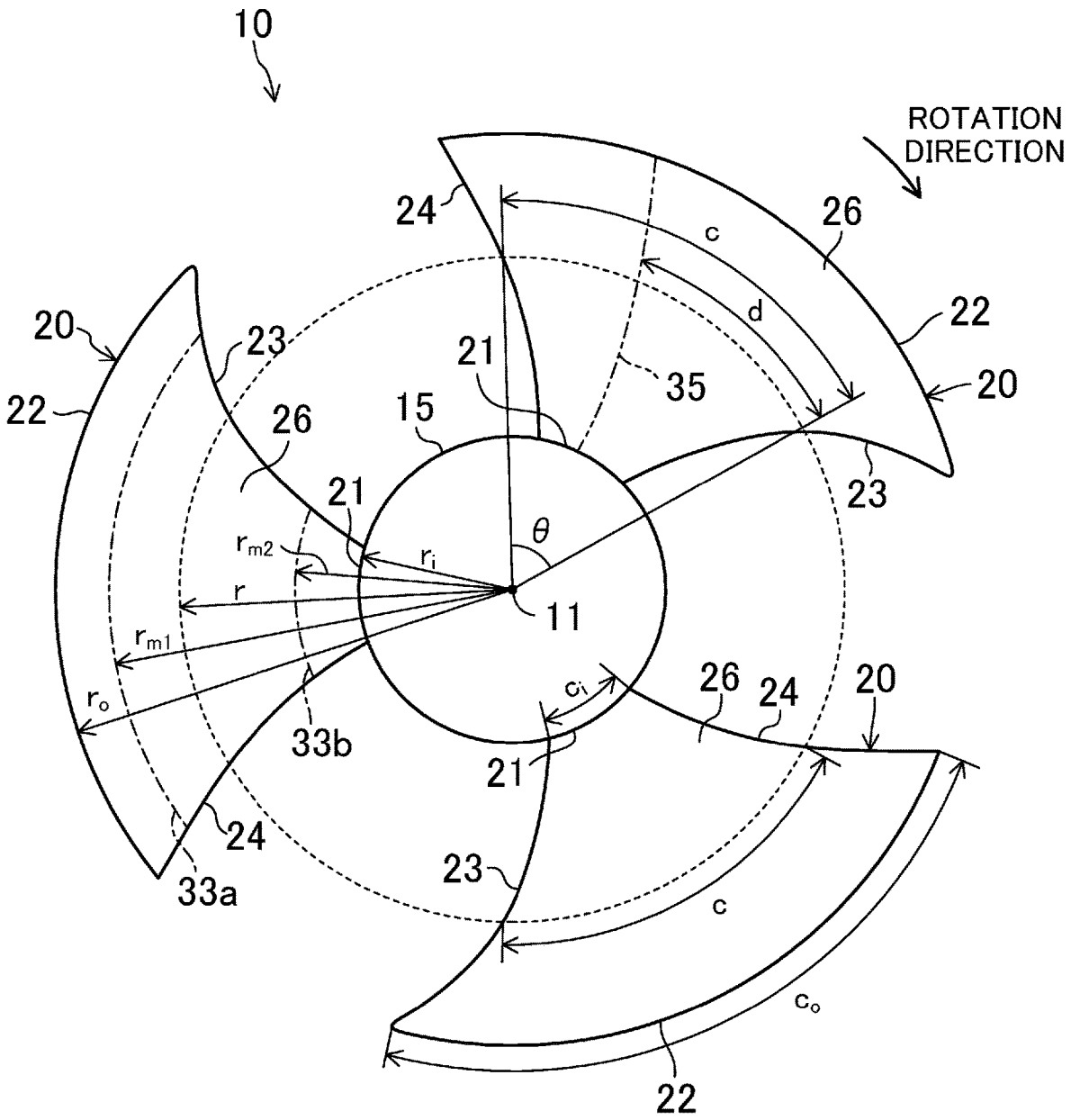
FIG. 12 is a plan view of the propeller fan of the second embodiment.

As shown in FIG. 11 and FIG. 12, the propeller fan (10) of this embodiment includes one hub (15) and three blades (20), as is the case with the propeller fan (10) of the first embodiment.

Detailed Shape of Blades

The shape of the blade (20) will be described in detail. The blade (20) of this embodiment is formed to have a curved shape so as to bulge in the direction of the negative pressure surface (26) side. In this point, the second embodiment has in common with the blades (20) of the first embodiment.

Camber Ratio

Figure 13:
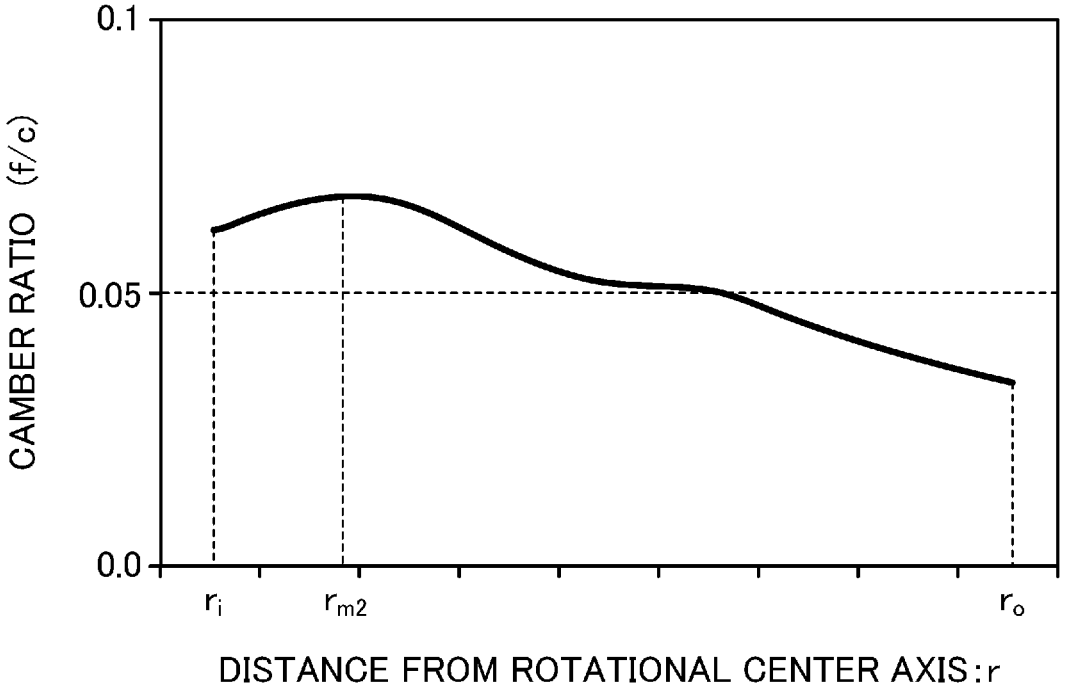
FIG. 13 is a graph showing a relationship between the distance r from the rotational center axis and the camber ratio (f/c) of the blade of the propeller fan of the second embodiment.

As shown in FIG. 13, in the blade (20) of this embodiment, the camber ratio (f/c), which is the ratio of the maximum camber f to the chord length c in the blade cross section, varies in accordance with the distance from the rotational center axis (11) of the propeller fan (10). This camber ratio (f/c) varies on a way from the blade root (21) to the blade end (22) such that the camber ratio becomes relative maximum only once and never becomes relative minimum.

Specifically, the camber ratio (f/c) reaches the maximum value ($f_{m2}/c_{m2}$) in the second reference blade cross section (33*b*) located between the blade root (21) and the blade end (22). Note that $f_{m2}$ is the maximum camber in the second reference blade cross section (33*b*), and $c_{m2}$ is the chord length in the second reference blade cross section (33*b*) (see FIG. 15B).

The camber ratio (f/c) decreases gradually in the direction from the second reference blade cross section (33*b*) toward the blade root (21), and gradually decreases in the direction from the second reference blade cross section (33*b*) toward the blade end (22). That is, when $r_i \le r \le r_{m2}$, the camber ratio (f/c) becomes larger as the distance r becomes larger, and when $r_{m2} \le r \le r_o$, the camber ratio (f/c) becomes smaller as the distance r becomes larger.

Here, the second reference blade cross section (33*b*) is a blade cross section at a position at which the distance from the rotational center axis (11) of the propeller fan (10) is represented by $r_{m2}$. That is, the second reference blade cross section (33*b*) is a blade cross section which is separated from the blade root (21) by a distance ($r_{m2}-r_i$). In this embodiment, the distance ($r_{m2}-r_i$) from the blade root (21) to the second reference blade cross section (33*b*) is about 15% of the distance ($r_o-r_i$) from the blade root (21) to the blade end (22). That is, the second reference blade cross section (33*b*) is located closer to the blade root (21) than to the center of the blade root (21) and the blade end (22) in the radial direction of the propeller fan (10).

In the blade (20) of this embodiment, the camber ratio ($f_o/c_o$) at the blade end (22) is smaller than the camber ratio ($f_i/c_i$) at the blade root (21). Specifically, the camber ratio ($f_o/c_o$) at the blade end (22) is about 55% of the camber ratio ($f_i/c_i$) at the blade root (21). Note that $f_i$ is the maximum camber in the blade root (21), and $c_i$ is the chord length in the blade root (21) (see FIG. 15A). Further, $f_o$ is the maximum camber at the blade end (22), and $c_o$ is the chord length at the blade end (22) (see FIG. 15C).

Maximum Camber Position Ratio

Figure 14:
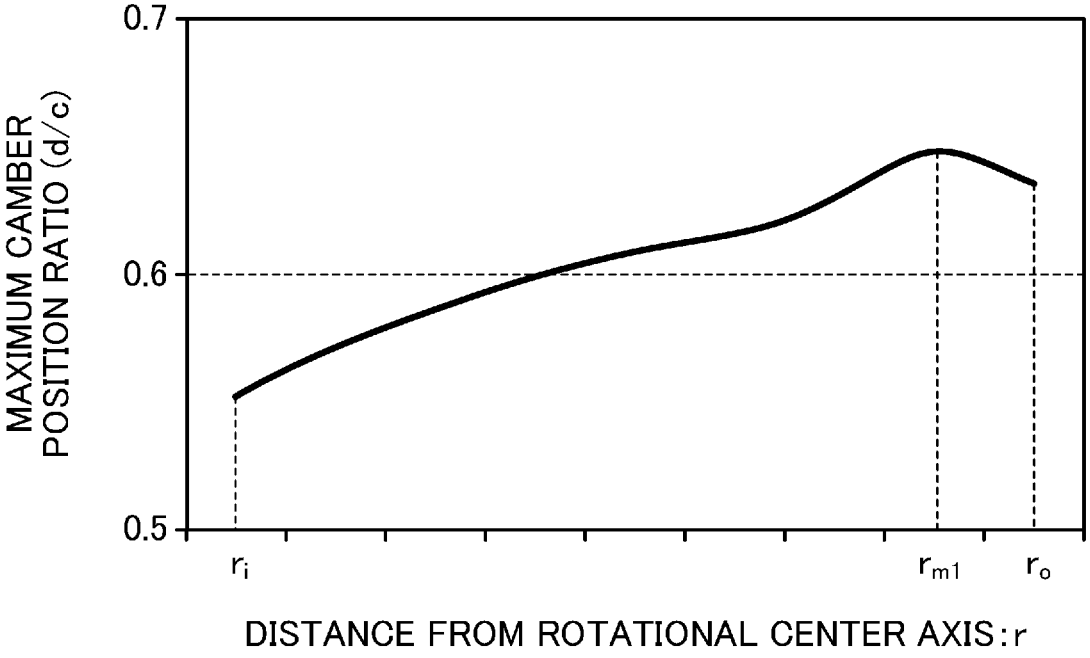
FIG. 14 is a graph showing a relationship between the distance r from the rotational center axis and the maximum camber position ratio (d/c) of the blade of the propeller fan of the second embodiment.

As shown in FIG. 14, in the blade (20) of this embodiment, the maximum camber position ratio (d/c), which is the ratio of the distance d between the leading edge (23) and the maximum camber position A to the chord length c, varies in accordance with the distance from the rotational center axis (11) of the propeller fan (10). The maximum camber position ratio (d/c) varies on a way from the blade root (21) to the blade end (22) such that the maximum camber position ratio becomes relative maximum only once and never becomes relative minimum.

Specifically, the maximum camber position ratio (d/c) has a maximum value ($d_{m1}/c_{m1}$) in the intermediate blade cross section (33*a*) located between the blade root (21) and the blade end (22). Note that $d_{m1}$ is the distance from the leading edge (23) to the maximum camber position A in the intermediate blade cross section (33).

The maximum camber position ratio (d/c) gradually increases in the direction from the intermediate blade cross section (33*a*) toward the blade root (21), and gradually decreases in the direction from the intermediate blade cross section (33*a*) toward the blade end (22). That is, when $r_i \le r \le r_{m1}$, the maximum camber position ratio (d/c) becomes larger as the distance r becomes larger, and when $r_{m1} \le r \le r_o$, the maximum camber position ratio (d/c) becomes smaller as the distance r becomes larger. As the maximum camber position ratio (d/c) increases, the maximum camber position A moves relatively farther away from the leading edge (23), and the maximum camber position A becomes relatively closer to the trailing edge (24). A maximum camber position line (35) connecting the maximum camber positions A in the blade cross section, which are positioned at certain distances from the rotational center axis (11) of the propeller fan (10), is indicated by a long dashed double-short dashed line in FIG. 12.

Here, the intermediate blade cross section (33*a*) is a blade cross section at a position at which the distance from the rotational center axis (11) of the propeller fan (10) is represented by $r_{m1}$. That is, the intermediate blade cross section (33*a*) is a blade cross section which is separated from the blade root (21) by a distance ($r_{m1}-r_i$). In this embodiment, the distance ($r_{m1}-r_i$) from the blade root (21) to the intermediate blade cross section (33*a*) is about 90% of the distance ($r_o-r_i$) from the blade root (21) to the blade end (22). That is, intermediate blade cross section (33*a*) is located closer to the blade end (22) than to the center of the blade root (21) and the blade end (22) in the radial direction of the propeller fan (10).

In the blade (20) of this embodiment, the maximum camber position ratio ($d_o/c_o$) at the blade end (22) is larger than the maximum camber position ratio ($d_i/c_i$) at the blade root (21). Note that $d_i$ is a distance from the leading edge (23) to the maximum camber position A in the blade root (21) (see FIG. 15A), and $d_o$ is a distance from the leading edge (23) to the maximum camber position A in the blade end (22) (see FIG. 15C).

In the blade (20) of this embodiment, the maximum camber position ratio (d/c) is set to a value equal to or greater than 0.55 and equal to or smaller than 0.65 in all the blade cross sections. As is the case with the blade (20) of the first embodiment, it is preferable in the blade (20) of this embodiment that the maximum camber position ratio (d/c) is set to a value equal to or greater than 0.5 and equal to or smaller than 0.8.

Attaching Angle

Figure 15A:
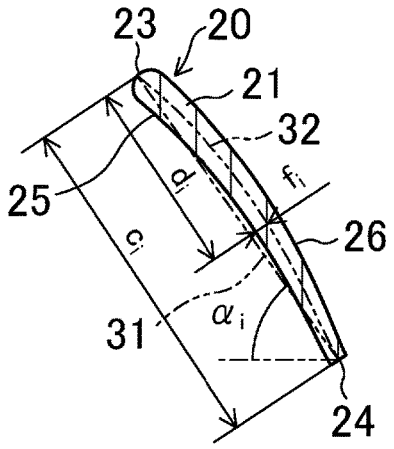
FIG. 15A is a cross-sectional view of the blade showing a blade cross section of the blade root of the blade of the propeller fan of the second embodiment.
Figure 15B:
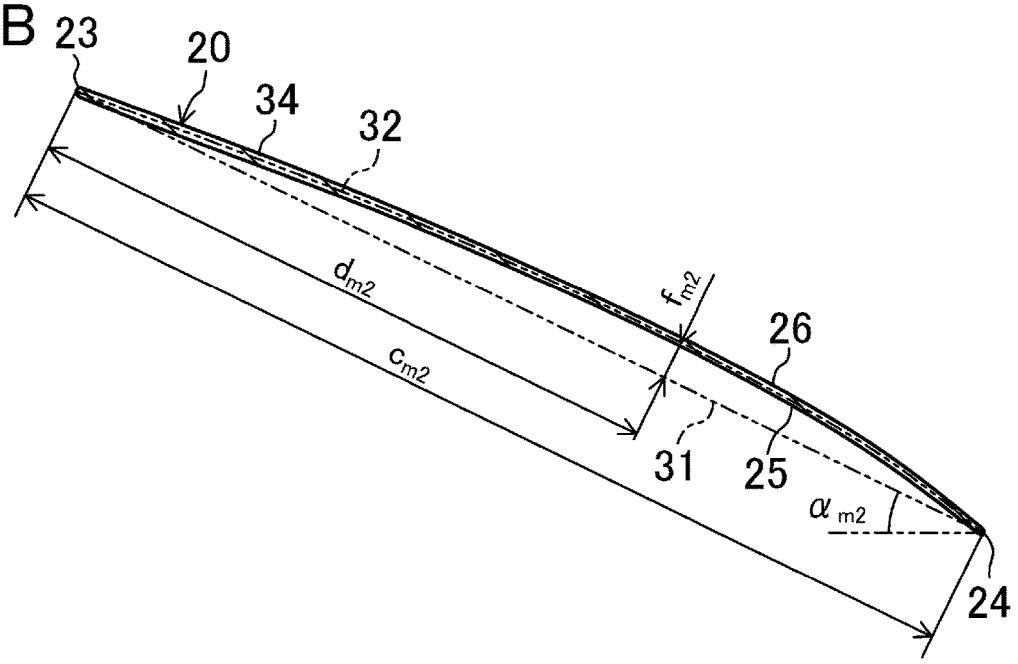
FIG. 15B is a cross-sectional view of the blade showing a second reference blade cross section of the blade of the propeller fan of the second embodiment.
Figure 15C:
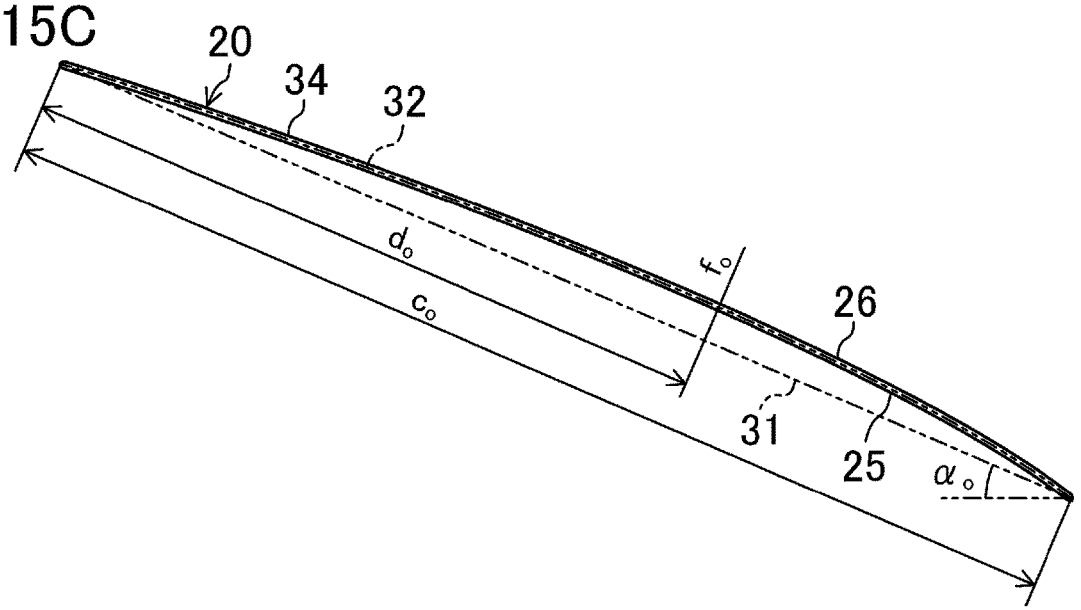
FIG. 15C is a cross-sectional view of the blade showing a blade cross section of a blade end of the blade of the propeller fan of the second embodiment.

As shown in FIG. 15A to FIG. 15C, in the blade (20) of this embodiment, the attaching angle $\alpha$ gradually decreases in the direction from the blade root (21) to the blade end (22) as is the case with the blade (20) of the first embodiment. That is, the attaching angle $\alpha$ becomes smaller in the blade cross section farther away from the rotational center axis (11) of the propeller fan (10). Therefore, in the blade (20) of this embodiment, the attaching angle $\alpha_i$ at the blade root (21) reaches the maximum value, and the attaching angle $\alpha_o$ at the blade end (22) reaches the minimum value.

Blowing Effect of Propeller Fan

The propeller fan (10) of this embodiment is driven by a fan motor connected to the hub (15), and rotates in the clockwise direction of FIG. 12. When the propeller fan (10) rotates, air is pushed out in the direction of the rotational center axis (11) of the propeller fan (10) by the blades (20). Further, in each blade (20) of the propeller fan (10), the air pressure on the positive pressure (25) side becomes higher than the atmospheric pressure, and the air pressure on the negative pressure surface (26) side becomes lower than the atmospheric pressure.

Relationship of Camber Ratio to Airflow

In the propeller fan (10) of this embodiment, the camber ratio (f/c) is smaller in the vicinity of the blade root (21) of the blade (20) where turbulence of airflow is likely to occur than in the second reference blade cross section (33*b*). Therefore, as is the case with the propeller fan (10) of the first embodiment, turbulence of airflow in the vicinity of the blade root (21) of each blade (20) is suppressed, and energy consumed by the disturbance is reduced. As a result, fan efficiency is improved, and power consumption of the fan motor driving the propeller fan (10) is reduced.

Further, in each blade (20) of the propeller fan (10) of this embodiment, the camber ratio (f/c) gradually decreases in the direction from the second reference blade cross section (33*b*) toward the blade end (22) where the circumferential speed is faster than that of the second reference blade cross section (33*b*). Therefore, the work amount of the blade (20) (specifically, the lift force applied to the blades (20)) is averaged over the entire blade (20), so that the fan efficiency is improved.

Moreover, in each blade (20) of the propeller fan (10) of this embodiment, the camber ratio ($f_o/c_o$) at the blade end (22) is approximately 56% of the camber ratio WO at the blade root (21). Therefore, similar to the propeller fan (10) of the first embodiment, the air differential pressure between the positive pressure surface (25) side and the negative pressure surface (26) side in the vicinity of the blade end (22) of each blade (20) is suppressed to an extent which is not excessively large. Therefore, the flow rate of air flowing from the positive pressure side (25) side to the negative pressure surface (26) side of the blade (20) can be reduced, and the blade end vortex (90) generated in the vicinity of the blade end (22) can be suppressed, so that fan efficiency can be improved.

Relationship Between Maximum Camber Position Ratio to Airflow

In each blade (20) of the propeller fan (10) of this embodiment, the maximum camber position ratio ($d_o/c_o$) at the blade end (22) is larger than the maximum camber position ratio ($d_i/c_i$) at the blade root (21). That is, at the blade end (22) of each blade (20), the maximum camber position A at which the camber becomes maximum in the blade cross section becomes relatively closer to the trailing edge (24) of the blade (20). In the blade (20) of this embodiment, similar to the blade (20) of the first embodiment, the position where the blade end vortex (90) is generated in the blade (20) of this embodiment is close to the trailing edge (24) of the blade (20). Therefore, the blade end vortex (90) is shortened so that energy consumed for the generation of the blade end vortex (90) is reduced, so that the energy consumption of the fan motor driving the propeller fan (10) is reduced.

Further, as described in connection with first embodiment, it is preferable in each blade (20) of the propeller fan (10) that the maximum camber position ratio (d/c) is set to a value equal to or greater than 0.5 and equal to or smaller than 0.8. In the propeller fan (10) of this embodiment, the maximum camber position ratio (d/c) of each blade (20) is set to a value equal to or greater than 0.55 and equal to or smaller than 0.65. As a result, a region where the airflow separates from the negative pressure surface (26) of the blade (20) is reduced, so that the blowing sound is reduced and the fan efficiency is improved.

In each blade (20) of the propeller fan (10) of this embodiment, the maximum camber position ratio (d/c) gradually decreases as approaching the blade root (21) in a region between the intermediate blade cross section (33*a*) and the blade root (21) (i. e., as the attaching angle $\alpha$ increases). Therefore, as is the case with the propeller fan (10) of the first embodiment, the airflow is less likely to separate from the negative pressure surface (26) of the blade (20).

Advantages of Second Embodiment

According to the propeller fan (10) of this embodiment, effects similar to those obtained by the propeller fan (10) of the first embodiment can be obtained.

INDUSTRIAL APPLICABILITY

As described above, the present invention is usable as a propeller fan for use in a blower or the like.

DESCRIPTION OF REFERENCE CHARACTERS

10 Propeller Fan
15 Hub
20 Blade
21 Blade Root
22 Blade End
31 Chord line
32 Mean line
33 Reference Blade Cross Section (First Reference Blade Cross Section, Second Reference Blade Cross Section)
33*a* Intermediate Blade Cross Section
33*b* Second Reference Blade Cross Section

The invention claimed is:

1. A propeller fan, comprising a hub formed into a cylindrical shape, and a plurality of blades extending outwardly from a side surface of the hub, wherein each of the plurality of blades is configured such that a distance from a chord line to a mean line in a blade cross section is set as a camber, that in the blade cross section, a position on the chord line where the camber becomes maximum is set as a maximum camber position, that a ratio of a distance between a leading edge and the maximum camber position in the blade cross section to a chord length is set as a maximum camber position ratio, that an end portion at a hub side of each of the plurality of blades is set as a blade root, that an end portion of an outer circumferential side of the each of the plurality of blades is set as a blade end, and that the maximum camber position ratio at the blade end is larger than the maximum camber position ratio at the blade root, wherein the maximum camber position ratio is minimum at a first reference blade cross section located between the blade root and the blade end.

2. The propeller fan of claim 1, wherein each of the plurality of blades is configured such that the maximum camber position ratio monotonically increases in the direction from the first reference blade cross section and the blade end toward the blade end and becomes maximum at the blade end.

3. The propeller fan of claim 2, wherein each of the plurality of blades is configured such that a distance from the blade root to the first reference blade cross section is shorter than a distance from the blade end to the first reference blade cross section.

4. The propeller fan of claim 2, wherein each of the plurality of blades is configured such that the maximum camber position ratio in the blade cross section is equal to or greater than 0.5 to equal to or less than 0.8.

5. The propeller fan of claim 2, wherein each of the plurality of blades is configured such that a maximum value of the camber in the blade cross section is set as a maximum camber, that a ratio of the maximum camber to the chord length in the blade cross section is set as a camber ratio, that the camber ratio becomes maximum in a second reference blade cross section located between the blade root and the blade end, monotonically decreases in the direction from the second reference blade cross section toward the blade root, and monotonically decreases in the direction from the second reference blade cross section toward the blade end, and that the first reference blade cross section serves as the second reference blade cross section.

6. The propeller fan of claim 5, wherein each of the plurality of blades is configured such that the camber ratio at the blade end is smaller than the camber ratio at the blade root.

7. The propeller fan of claim 1, wherein
each of the plurality of blades is configured such that
a maximum value of the camber in the blade cross section is set as a maximum camber, that
a ratio of the maximum camber to the chord length in the blade cross section is set as a camber ratio, and that
the camber ratio becomes maximum in a second reference blade cross section located between the blade root and the blade end, monotonically decreases in the direction from the second reference blade cross section toward the blade root, and monotonically decreases in the direction from the second reference blade cross section toward the blade end.

8. The propeller fan of claim 7, wherein
each of the plurality of blades is configured such that the camber ratio at the blade end is smaller than the camber ratio at the blade root.

9. A propeller fan, comprising a hub formed into a cylindrical shape, and a plurality of blades extending outwardly from a side surface of the hub, wherein
each of the plurality of blades is configured such that
a distance from a chord line to a mean line in a blade cross section is set as a camber, that in the blade cross section,
a position on the chord line where the camber becomes maximum is set as a maximum camber position, that
a ratio of a distance between a leading edge and the maximum camber position in the blade cross section to a chord length is set as a maximum camber position ratio, that
an end portion at a hub side of each of the plurality of blades is set as a blade root, that
an end portion of an outer circumferential side of the each of the plurality of blades is set as a blade end, and that
the maximum camber position ratio at the blade end is larger than the maximum camber position ratio at the blade root, wherein
each of the plurality of blades is configured such that the maximum camber position ratio becomes maximum in an intermediate blade cross section located between the blade root and the blade end.

10. The propeller fan of claim 9, wherein
each of the plurality of blades is configured such that the maximum camber position ratio becomes minimum at the blade root and monotonically increases in the direction from the blade root toward the intermediate blade cross section.

11. The propeller fan of claim 9, wherein
each of the plurality of blades is configured such that a distance from the blade root to the intermediate reference blade cross section is longer than a distance from the blade end to the intermediate reference blade cross section.

12. The propeller fan of claim 9, wherein
each of the plurality of blades is configured such that
a maximum value of the camber in the blade cross section is set as a maximum camber, that
a ratio of the maximum camber to the chord length in the blade cross section is set as a camber ratio, and that
the camber ratio becomes maximum in a second reference blade cross section located between the blade root and the blade end, monotonically decreases in the direction from the second reference blade cross section toward the blade root, and monotonically decreases in the direction from the second reference blade cross section toward the blade end.

13. The propeller fan of claim 12, wherein
each of the plurality of blades is configured such that the camber ratio at the blade end is smaller than the camber ratio at the blade root.

* * * * *